US010001316B2

(12) United States Patent
Simpson et al.

(10) Patent No.: US 10,001,316 B2
(45) Date of Patent: Jun. 19, 2018

(54) FREEZER AIR TOWER AND DAMPER

(71) Applicant: Electrolux Home Products, Inc., Charlotte, NC (US)

(72) Inventors: Cory Dale Simpson, Abbeville, SC (US); Benjamin Mobley, Iva, SC (US); Luis Clasen, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 621 days.

(21) Appl. No.: 14/497,237

(22) Filed: Sep. 25, 2014

(65) Prior Publication Data

US 2016/0091238 A1 Mar. 31, 2016

(51) Int. Cl.
*F25D 17/06* (2006.01)
*F25D 17/04* (2006.01)

(52) U.S. Cl.
CPC ..... *F25D 17/067* (2013.01); *F25D 17/045* (2013.01); *F25D 2317/067* (2013.01)

(58) Field of Classification Search
CPC ..... F25D 17/04; F25D 17/045; F25D 17/065; F25D 2317/063; F25D 17/062; F25D 17/067; F25D 17/06; F25D 2317/067; F25D 2317/061; F25D 23/061; F25D 23/068; F24F 13/08; F24F 13/084; F24F 13/12
USPC ..... 62/408
See application file for complete search history.

(56) References Cited

U.S. PATENT DOCUMENTS 3,082,678 A * 3/1963 Padgett ..... F24F 13/1426 454/327
3,359,750 A 12/1967 Hanson
3,373,576 A * 3/1968 Dodge, III ..... F25D 11/02 62/180
4,488,412 A * 12/1984 Weaver ..... F25D 17/045 62/382
4,539,819 A * 9/1985 Alba ..... F25D 17/065 62/265
4,642,998 A * 2/1987 Kang ..... F25D 17/045 62/187
4,914,928 A 4/1990 Fellwock et al.
4,920,765 A * 5/1990 McCauley ..... F25D 17/045 62/187
5,092,136 A * 3/1992 Kang ..... F04D 29/4246 137/872
5,097,675 A 3/1992 Elsom et al.
(Continued)

*Primary Examiner* — Jiangying Atkisson
*Assistant Examiner* — For K Ling
(74) *Attorney, Agent, or Firm* — Pearne & Gordon LLP

(57) ABSTRACT

An air tower adapted to be located within a compartment of a refrigeration appliance comprises a first plenum chamber in fluid communication with a first compartment of the refrigeration appliance, a second plenum chamber in fluid communication with a second compartment of the refrigeration appliance, a damper connecting the first plenum chamber to the second plenum chamber, and a movable part within the damper configured to be moveable between a first position and a second position. When moved to the first position, the movable part is relatively closer to interior side walls to thereby restrict air flow from the first plenum chamber to the second plenum chamber. When moved to the second position, the movable part is relatively further away from the interior side walls to thereby permit more air flow from the first plenum chamber to the second plenum chamber.

14 Claims, 11 Drawing Sheets

(56) References Cited

U.S. PATENT DOCUMENTS

| | | | | |
|---|---|---|---|---|
| 5,369,963 | A * | 12/1994 | Pickles | F25D 17/045 62/408 |
| 6,199,400 | B1 * | 3/2001 | Banicevic | F25D 17/045 62/187 |
| 6,318,099 | B1 * | 11/2001 | Hwang | F25D 17/045 62/187 |
| 6,655,169 | B2 | 12/2003 | Tupis et al. | |
| 6,735,975 | B2 * | 5/2004 | Jeon | F25D 17/045 62/126 |
| 7,260,957 | B2 | 8/2007 | Kalyanavaradhan et al. | |
| 7,665,320 | B2 | 2/2010 | Scrivener et al. | |
| 7,765,819 | B2 | 8/2010 | Anell et al. | |
| 7,856,844 | B2 * | 12/2010 | Kim | F25D 17/065 62/407 |
| 8,037,701 | B2 | 10/2011 | Anell et al. | |
| 2006/0070395 | A1 * | 4/2006 | Lee | F25D 17/045 62/408 |

* cited by examiner

FREEZER AIR TOWER AND DAMPER

BACKGROUND OF THE INVENTION

1. Field of the Invention

The present invention relates generally to an air tower mounted to a liner in a freezer compartment of a refrigerator and more specifically to a damper within said air tower that can be selectively controlled to apportion cold air flow from the freezer compartment to refrigerating compartment of the refrigerator.

2. Description of Related Art

Refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C. and the freezer compartments at temperatures below 0° C.

In some cases, the refrigerator is provided with two cooling systems, one system delivering cooling air into the freezer compartment and a separate system delivering cooling air at a higher temperature into the fresh food compartment. In other cases, cooling air is first delivered into the freezer compartment to establish a freezer compartment temperature and with a portion of the cooling air further directed to the fresh food compartment to maintain a desired fresh food compartment temperature. In the latter configuration, cooling air is guided through a passageway that is in fluid communication with the cooling system and both the freezer and fresh food compartments. A damper is typically arranged within the passageway to selectively allow cooling air to pass into one, the other or both of the freezer and fresh food compartments.

SUMMARY

According to one aspect, the subject application involves a refrigeration appliance having an air tower with a damper to control a flow of cooling air from an evaporator to a freezer compartment and a fresh food compartment. Some objectives of the subject application include providing instant air flow regulation, preventing frost build up in the freezer compartment and reducing energy consumption.

In accordance with one embodiment of the invention, a cooling air passageway is formed substantially by interior side walls on a back surface of the air tower. A damper is slidably mounted to the air tower by having a concave groove slidably fitting with the guide rails on the back surface of the air tower. The damper divides the passageway into a first plenum chamber in fluid communication with the freezer compartment, a second plenum chamber in fluid communication with the fresh food compartment, and a damper connecting the first plenum chamber to the second plenum chamber. The interior side walls are disposed in such a manner that the walls curve in sharply at one end of damper and form a narrowest point of the passageway, and gradually the walls curve out towards the other end of the damper and resulting in a wider passageway. Consequently, when the damper is slid to a first position where the passageway is narrowest, the cross-sectional area between the damper and the interior side walls is at a narrowest state, thereby allowing the least amount of air to flow into the second plenum chamber. As the damper is being slid downwards, the cross-sectional area between the damper and the interior side walls widens, and more and more cooling air is flowing into the second plenum chamber. The cross-sectional area between the damper and the interior side walls is at a widest state when damper is slid all the way down to a second position.

In further accordance with this embodiment, the damper has a knob that extends outwardly through an opening in the air tower into the interior of the freezer compartment. By holding on to the knob, the user may selectively slide the damper to the first position, the second position, or an infinite number of positions between the first position and the second position, to control the amount of cooling air flown into the second plenum chamber and ultimately fresh food compartment. The damper is considered at the first position when the knob reaches the upper rim of the opening on the air tower, and at the second position when the knob reaches the lower rim of the opening on the air tower.

In accordance with another embodiment of the invention, the interior side walls of the air tower are raised ribs that are substantially perpendicular to the back surface of the air tower.

In accordance with another embodiment of the invention, the interior side walls in the damper have a height greater or equal to the height of the main body portion of the damper. This creates a space between the damper and the evaporator coil cover, which allows a minimum amount of air flowing from the first plenum chamber to the second plenum chamber, regardless of the position of the damper along the rail.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

DETAILED DESCRIPTION

Figure 1:
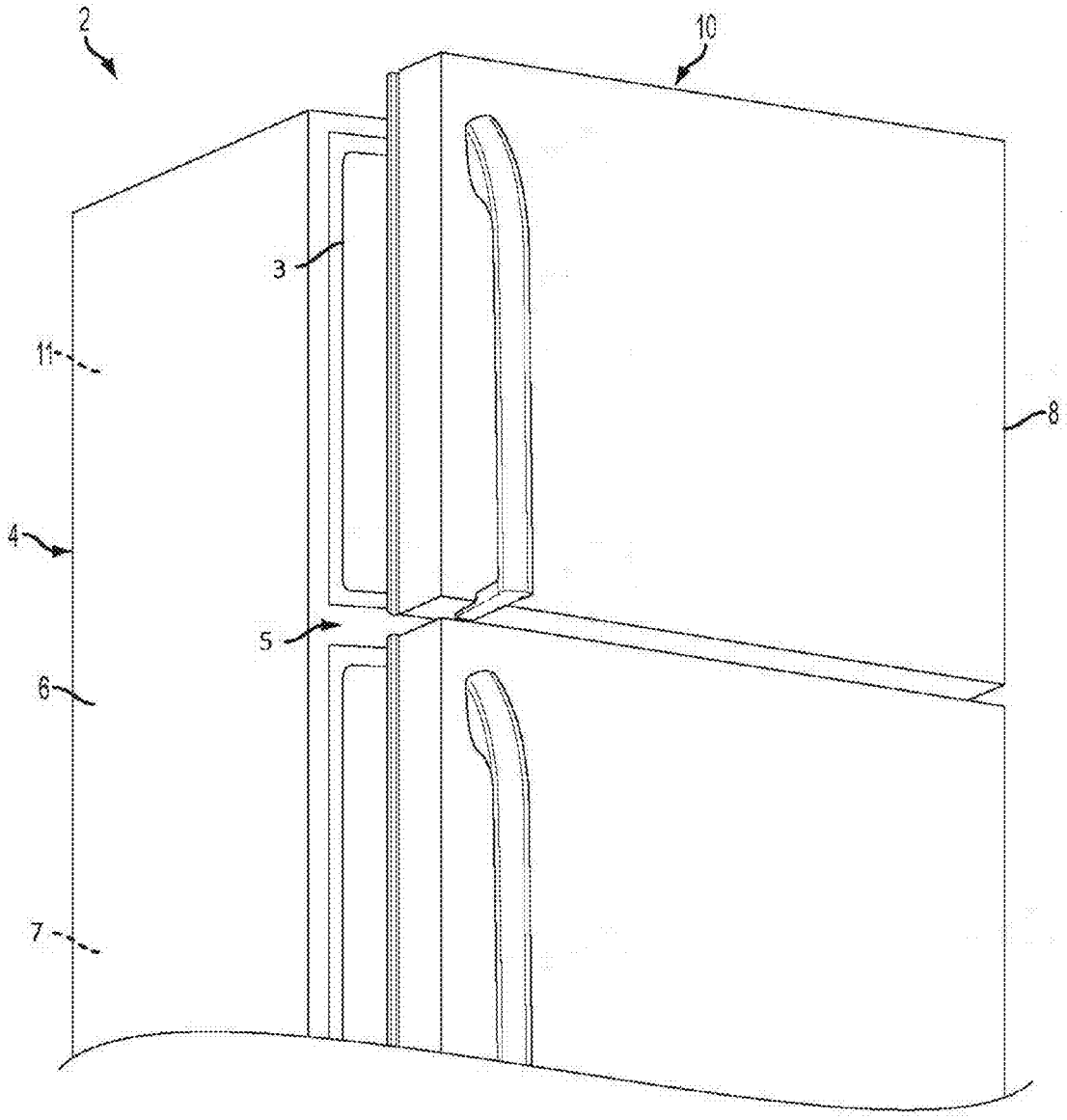
FIG. 1 is a perspective view of a top mount refrigerator.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

It is also to be noted that the phrase "at least one of", if used herein, followed by a plurality of members herein means one of the members, or a combination of more than one of the members. For example, the phrase "at least one of a first position and a second position" means in the present application: the first position, the second position, or the first position and the second position. Likewise, "at least one of a first position, a second position and a third position" means in the present application: the first position, the second position, the third position, the first position and the second position, the first position and the third position, the second position and the third position, or the first position and the second position and the third position.

Although some embodiments described in detail below, and shown in the figures as a top-mount configuration of a refrigerator having an air duct formed in the foam insulation between the fresh food compartment and the freezer compartment, the refrigerator can have any desired configuration including at least a fresh food compartment and a freezer compartment, an evaporation fan, and an air duct in fluid communication with the freezer and the fresh food compartments, without departing from the scope of the present invention.

Turning to the shown example of FIG. 1, a refrigeration appliance in the form of a refrigerator 2 is illustrated as a top-mount refrigerator with freezer and fresh food compartments. While the present application is described herein by way of attaching a fan mounting assembly, a coil cover and a fan tower to the liner of an example refrigeration appliance, it is contemplated that various other appliances could also be used, such as stoves, microwaves, stand-alone refrigerators, or freezers, as well as other configurations of combined refrigerator/freezers.

The arrangement of the fresh food and freezer compartments with respect to one another in such refrigerators vary. For example, in some cases, the freezer compartment is located above the fresh food compartment (i.e., a top mount refrigerator), and in other cases the freezer compartment is located below the fresh food compartment (i.e. a bottom mount refrigerator). Additionally, many modern refrigerators have their freezer compartments and fresh food compartments arranged in a side-by-side relationship. Whatever arrangement of the freezer compartment and the fresh food compartment is employed, typically, separate access doors are provided for the refrigerated compartments so that either compartment may be accessed without exposing the other compartment to the ambient air. For example, a door provides access to the freezer compartment, and a door provides access to the fresh food compartment of the refrigerator. While the present application is described herein by way of an example top mount refrigerator configuration, it is contemplated that any refrigerator configuration can be used, such as bottom-mount refrigerators having at least one door.

Referring to FIG. 1, an insulated cabinet constructed in accordance with the present invention is generally indicated at 2. Cabinet 2 includes a cabinet shell 4 defined, at least in part, by first and second upstanding side panels 6 and 8 that are interconnected and laterally spaced by a top panel 10. Although not shown in this figure, cabinet shell 4 would also include a rear panel and internal reinforcing structure. A liner 3 inside the shell can define spaces. Foam insulation may be used between the cabinet shell 4 and the liner 3. Since refrigerator cabinet 2 represents a top mount-type refrigerator, a divider portion 5 is provided which extends laterally across shell 4 and divides refrigerator cabinet 2 into an upper space that can be used as a freezer compartment 11, and a lower space that can be used as a fresh food compartment 7. Alternatively, the divider portion 5 can divide the refrigerator cabinet 2 into an upper fresh food compartment, and a lower freezer compartment.

Figure 2:
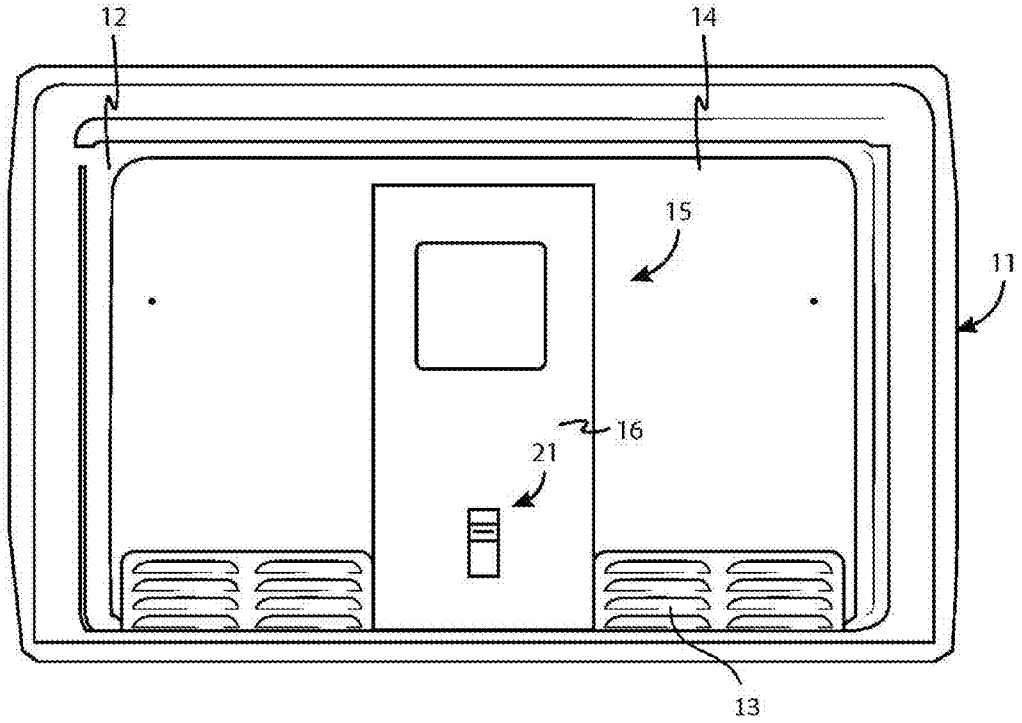
FIG. 2 shows a front view looking into a compartment of the in which an air tower assembly is coupled to an evaporator coil cover.

Referring to FIG. 2, the freezer compartment 11 shown in FIG. 1 has a rear liner 12. In one embodiment, an evaporator coil cover 14 is attached to the rear liner 12. The evaporator coil cover 14 can be coupled to the rear liner 12 by any suitable mechanical (e.g., screws, rivets, nuts and bolts, etc . . . ), chemical (e.g., adhesive, epoxy, etc . . . ) or other type of fastener. Vents 13 are provided in a lower portion of the evaporator coil cover 14 that allow a circulation of air pulled by the fan through the evaporator. An air tower 15 is attached to the lower center area of the evaporator coil cover 14 with a surface 16 facing the interior of the freezer compartment. It is contemplated that the evaporator coil cover 14 can be located inside the fresh food compartment 7 without departing from the scope of the present invention.

Figure 3:
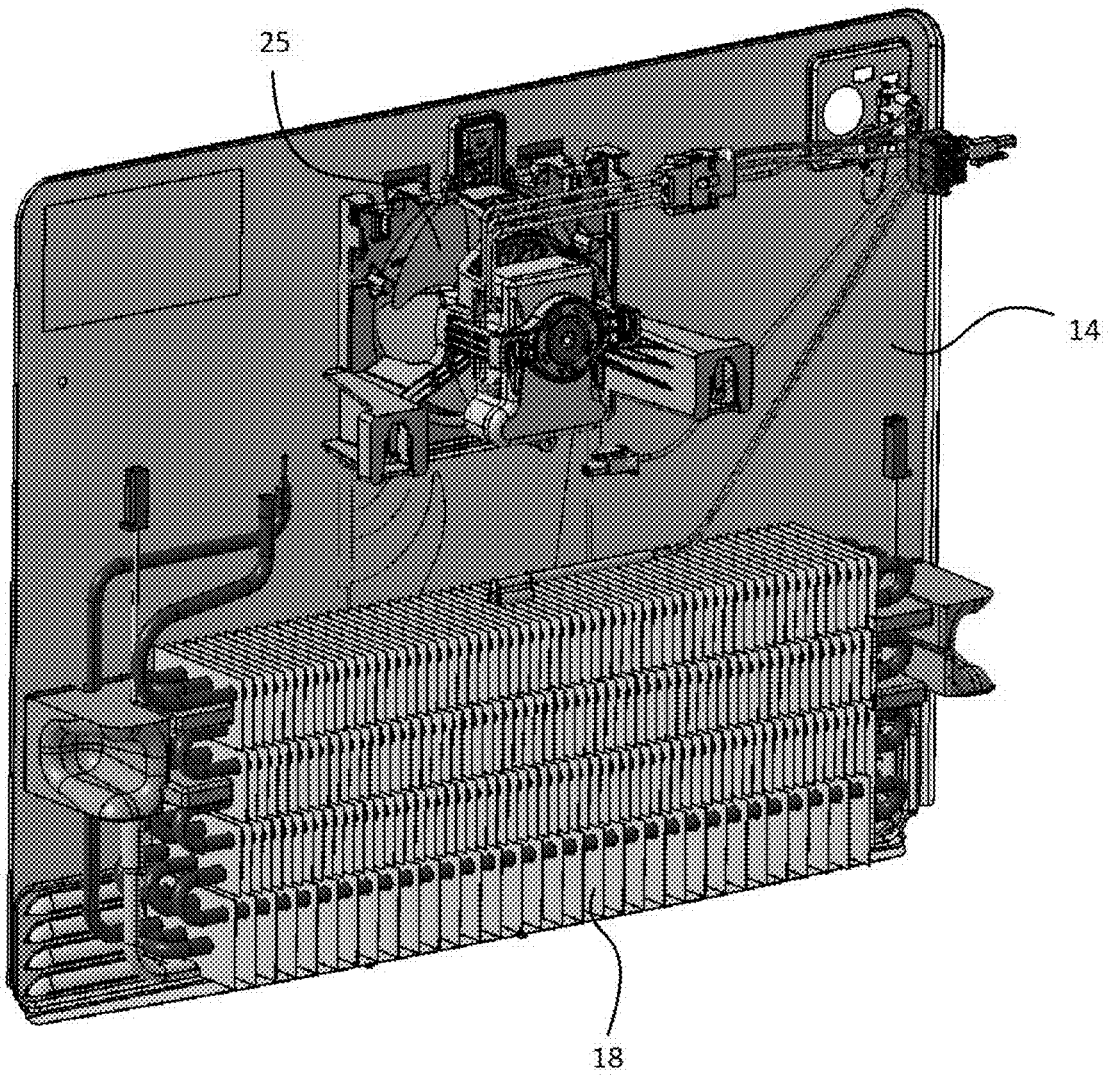
FIG. 3 shows a back view of the evaporator coil cover.
Figure 4:
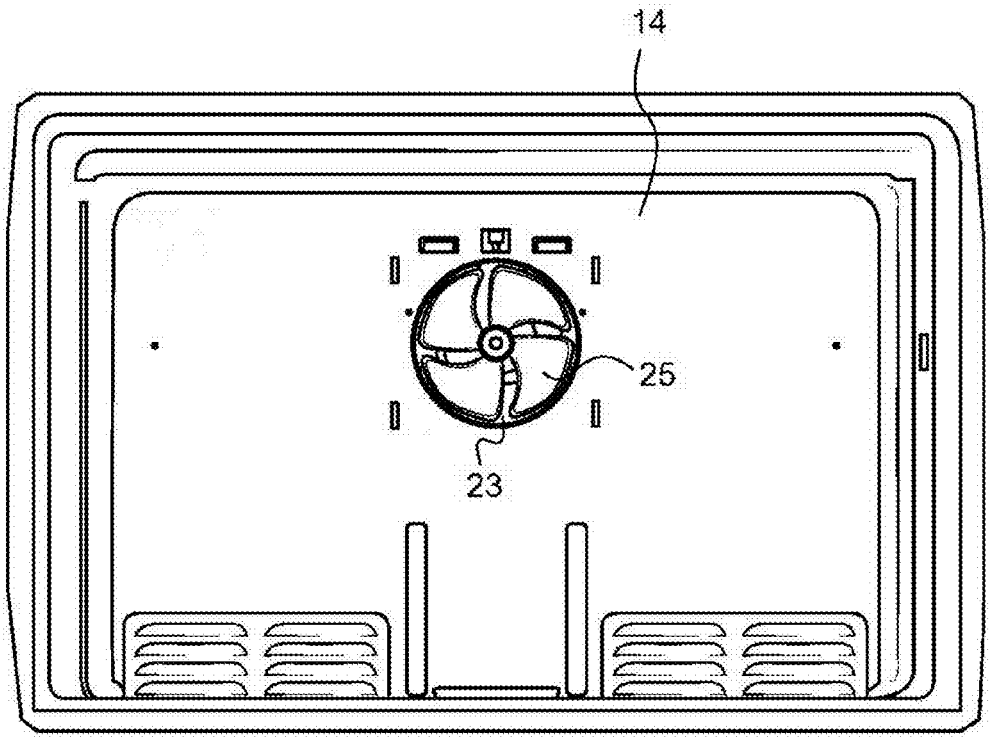
FIG. 4 shows an embodiment of the evaporator coil cover having the air tower removed.

In the shown example in FIG. 3, evaporator coil 18 can be provided below an evaporator fan 25, and between the evaporator coil cover 14 and the rear liner 12. Referring to FIG. 4, in one embodiment, the evaporator coil cover 14 has a fan opening 23 for fan blades of the fan 25. The fan opening can be located in an upper center of the evaporator coil cover 14 and surrounded by various slots. The opening on the evaporator coil cover can be coaxial with the shaft from the fan 25. To mount the air tower 15 to the evaporator coil cover 14, snap tabs can be provided on a back surface of the air tower 15 to snap into one of the various slots surrounding the fan opening on the evaporator coil cover. Alternatively, any suitable mechanical (e.g., screws, rivets, nuts and bolts, etc . . . ), chemical (e.g., adhesive, epoxy, etc . . . ) or other type of fastener can be used.

Figure 5A:
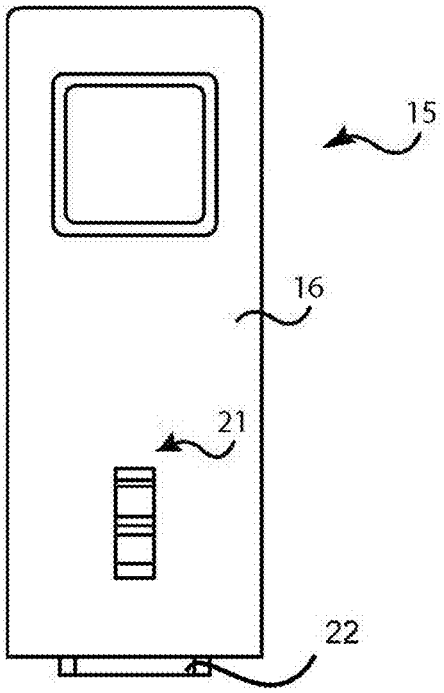
FIG. 5*a* shows a front view of the air tower.
Figure 5B:
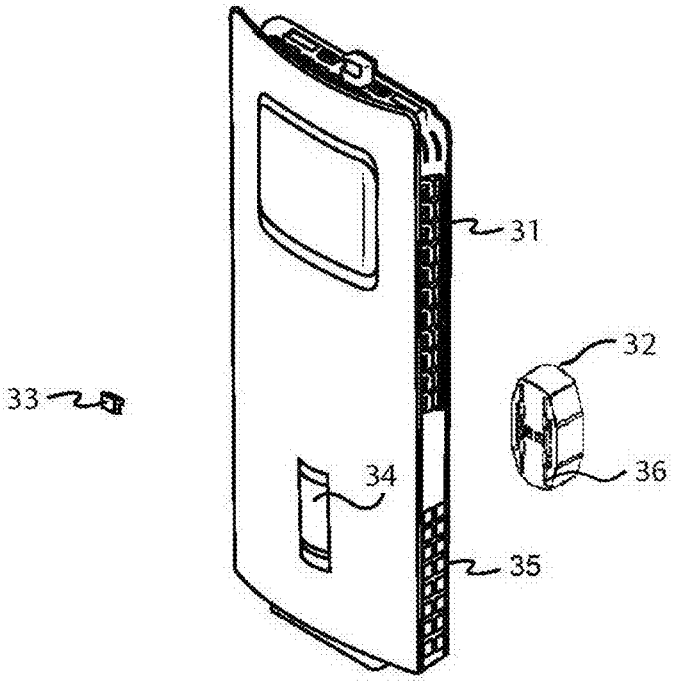
FIG. 5*b* is a separated view showing the air tower, a damper and a damper knob in perspective and illustrating their relative positions.

As seen in FIG. 5*a*, the air tower 15 serves to distribute cool air discharged from the evaporator fan 25 throughout the freezer compartment 11 and fresh food compartment 7 of the refrigerator. In one embodiment, bottom edge 22 of the air tower 15 is insertable into a foamed-in air duct that is in fluid communication with the fresh food compartment of the refrigerator, so to permit the air tower 15 to provide cool air discharged from the evaporator fan 25 to the fresh food compartment 7. Vents 31, as shown in FIG. 5*b*, are disposed on top and upper sides of the air tower 15 to distribute cool air to the freezer compartment 11. Vents 35 are disposed on lower sides of the air tower 15 to return air from the freezer compartment 11 to the air tower 15 for recirculation.

Figure 6:
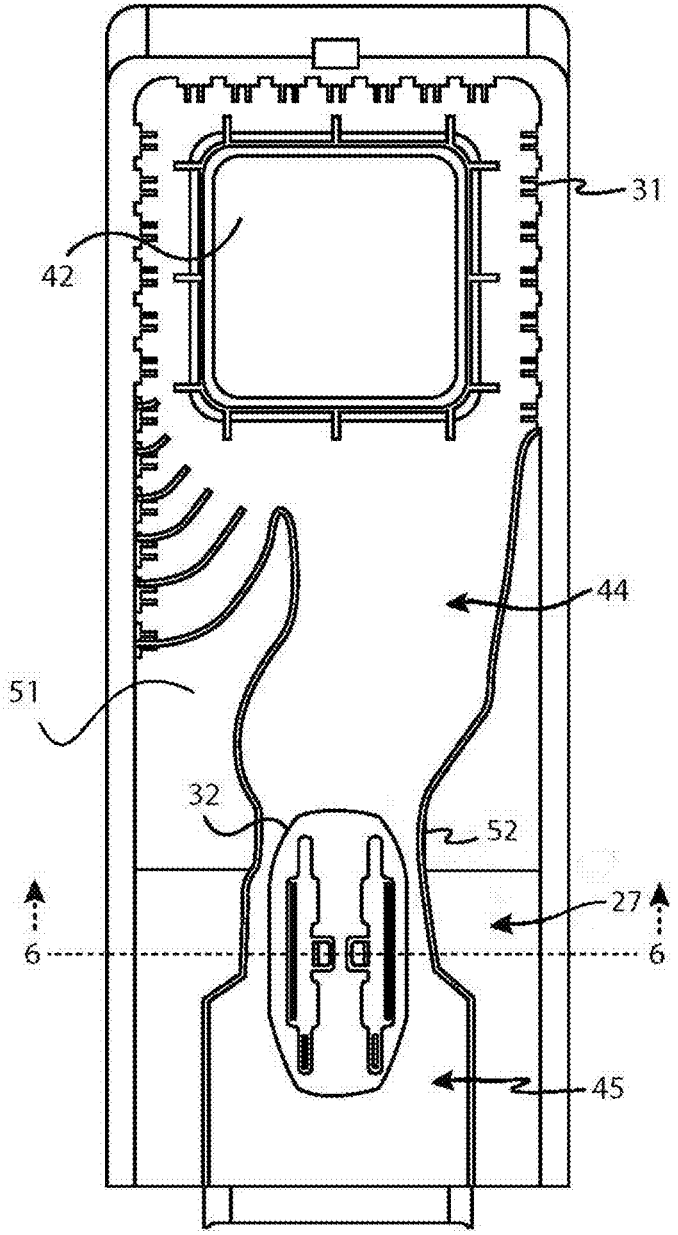
FIG. 6 shows a back view of the air tower.

Referring to FIG. 6, a damper 27 is located in the lower center of the air tower 15. The damper 27 comprises at least two spaced apart walls 52 and a movable part 21. As seen in FIG. 5*a* and FIG. 5*b*. The movable part 21 comprises a main body 32 that is located between the air tower 15 and the evaporator coil cover 14, and a knob 33 attached to the main body 32 that protrudes away from the surface 16 of the air tower 15 through an opening 34 on the air tower 15. In one embodiment, the main body 32 has two parallel sliding grooves 36 that can be slidably coupled to respective guide rails 96 (see FIG. 10*b*) that are located adjacent to the opening 34, on the back surface side of the air tower 15 as will be discussed more fully below.

Referring to FIG. 6, the air tower 15 has a back surface 51 that faces the evaporator coil cover. A recess area 42 is located generally in the upper center of the back surface 51 in receiving the fan blades of the fan 25. In accordance with the invention, cooling air is directed from the fan 25, through the fan opening 23 on the evaporator coil cover 14, into the recess area 42, and is then diffused to at least one air passageway along the back surface 51 of the air tower 15. As best shown in FIG. 6 that illustrates an embodiment of the present invention, the main body 32 of the movable part 21 divides the air passageway into a first plenum chamber 44 surrounding the recess area 42, a second plenum chamber 45 towards the bottom of the air passageway, and a damper 27 connecting the first plenum chamber 44 to the second plenum chamber 45, and defined by at least two spaced apart interior side walls 52. The movable part 21 is located inside the damper 27. Part of the cooling air diffused into the first plenum chamber 44 will enter the freezer compartment through the vents 31 disposed on top and upper sides of the air tower 15, and the remaining air will be directed to the second plenum chamber 45 through the damper 27, and further into the fresh food compartment via the air duct.

Figure 7:
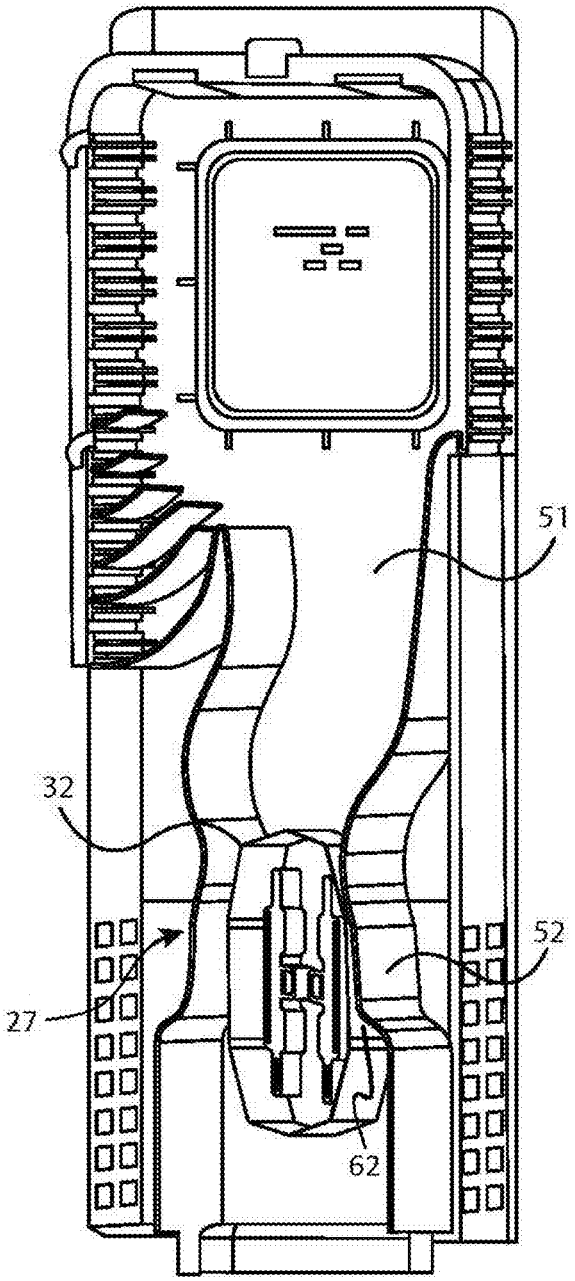
FIG. 7 shows a perspective back view of the air tower.

In accordance with the embodiment shown in FIG. 7, the two spaced apart interior side walls 52 can be raised ribs disposed essentially perpendicular to the back surface 51 in a predetermined arrangement. As further illustrated in FIG. 8, in one embodiment, the interior side walls 52 of the damper 27 have a height greater than the height of the main body 32 of the movable part 21. This creates a space 66 between the main body 32 and the evaporator coil cover 14, which allows a minimum amount of air flowing from the first plenum chamber 44 to the second plenum chamber 45, regardless of the position of the movable part along the rail. Cooling air may also flow through spaces 64A and 64B formed between side surfaces 62 of the main body 32 and the two spaced apart interior side walls 52. These spaces 64A and 64B are adjustable depends on the position of the movable part 21, as will be discussed more fully below.

Figure 9A:
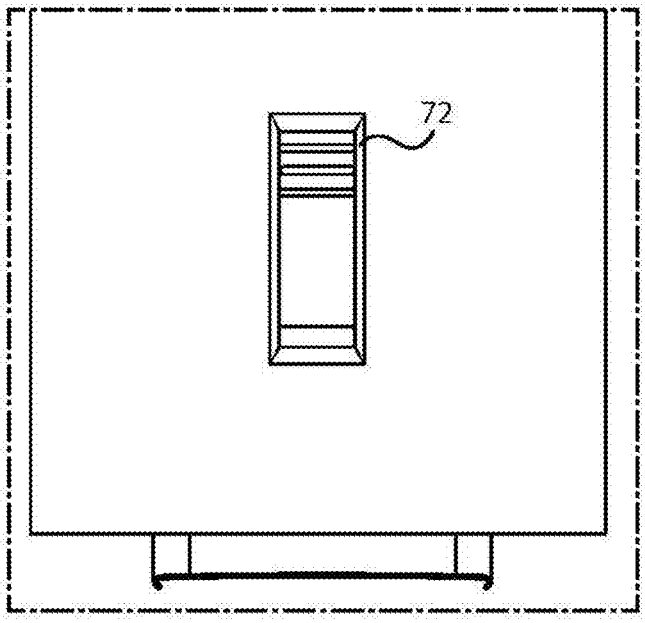
FIG. 9*a* shows a front, detail view of the damper showing the damper in a first position.
Figure 9B:
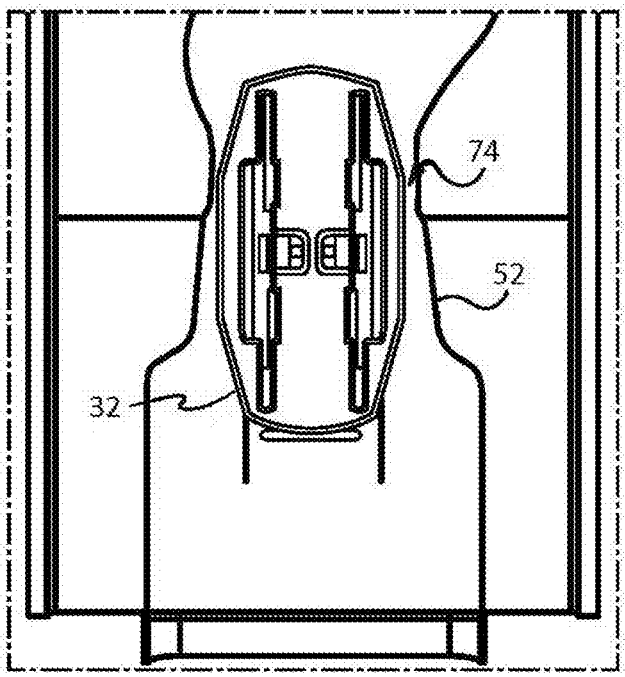
FIG. 9*b* shows a back, detail view of the damper showing the damper in the first position as in FIG. 9*a*.
Figure 10A:
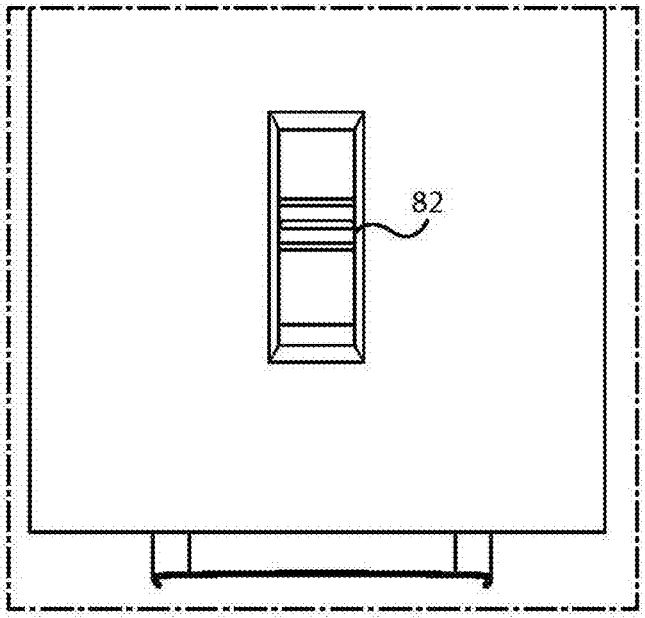
FIG. 10*a* shows a front, detail view of the damper showing the damper in a third position.
Figure 10B:
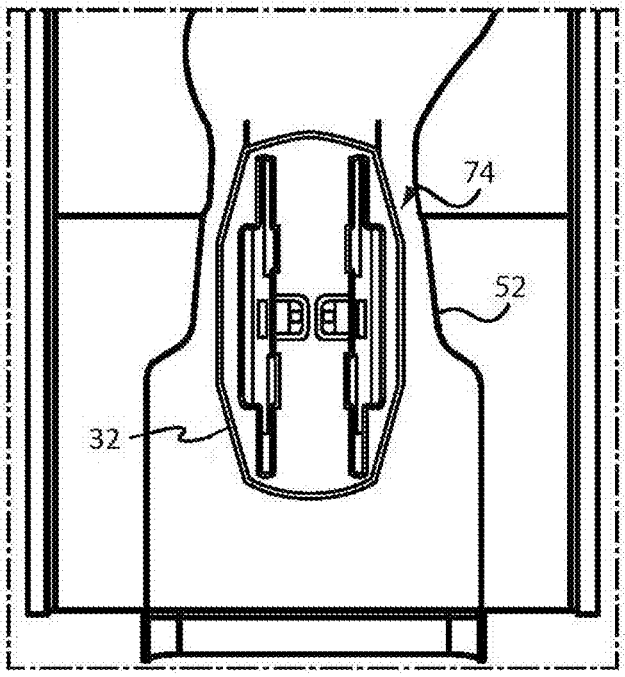
FIG. 10*b* shows a back, detail view of the damper showing the damper in the third position as in FIG. 10*a*.
Figure 11A:
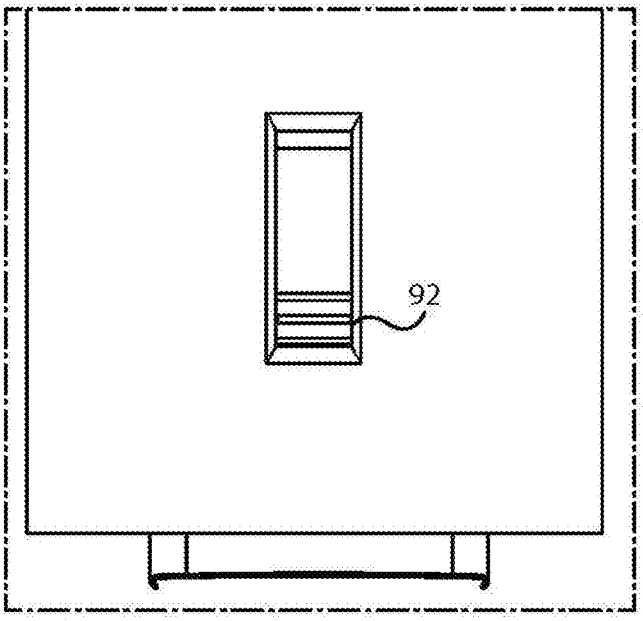
FIG. 11*a* shows a front, detail view of the damper showing the damper in a second position.
Figure 11B:
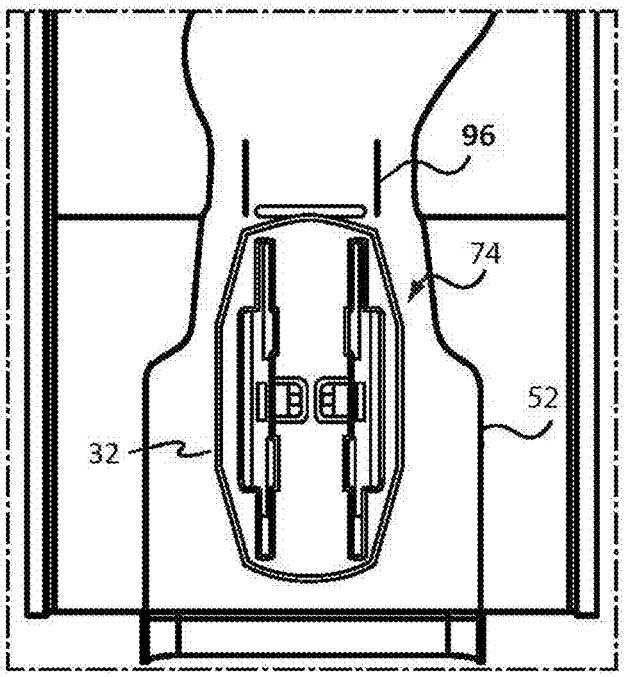
FIG. 11*b* shows a back, detail view of the damper showing the damper in the second position as in FIG. 11*a*.

One embodiment of the airflow adjusting function of the damper is better understood when the detailed description below is read with reference to the accompanying drawings, in which: FIGS. 9*a* and 9*b* illustrate that when the movable part 21 is moved to a first position 72 (a.k.a. a Coldest Setting for the freezer); FIG. 11*a* and FIG. 11*b* illustrate that when the movable part 21 is moved to a second position 92 (a.k.a. a Warm Setting for the freezer); and FIG. 10*a* and FIG. 10*b* illustrate that when the movable part 21 is moved to a third position 82 (a.k.a. a Mid Setting for the freezer).

In further accordance with the embodiment shown, the main body 32 of the movable part 21 comprises two parallel concave grooves (see FIG. 5*b*) adjacent and generally perpendicular to the knob 33. As shown in FIG. 11*b*, the two parallel concave grooves are slidably fitting with two guide rails 96 on the back surface 51 of the air tower 15. The damper is therefore configured to be movable linearly between the first position 72 and the second position 92. In the shown example, the movable part 21 is considered slid to the first position 72 when the knob 33 reaches the upper rim of the opening 34, and the movable part 21 is considered slid to the second position 92 when the knob 33 is slid downwards and reaches the bottom rim of the opening 34. It is contemplated that the groove and the rail can be curved, zigzag, or in any non-linear shape.

Figure 8:
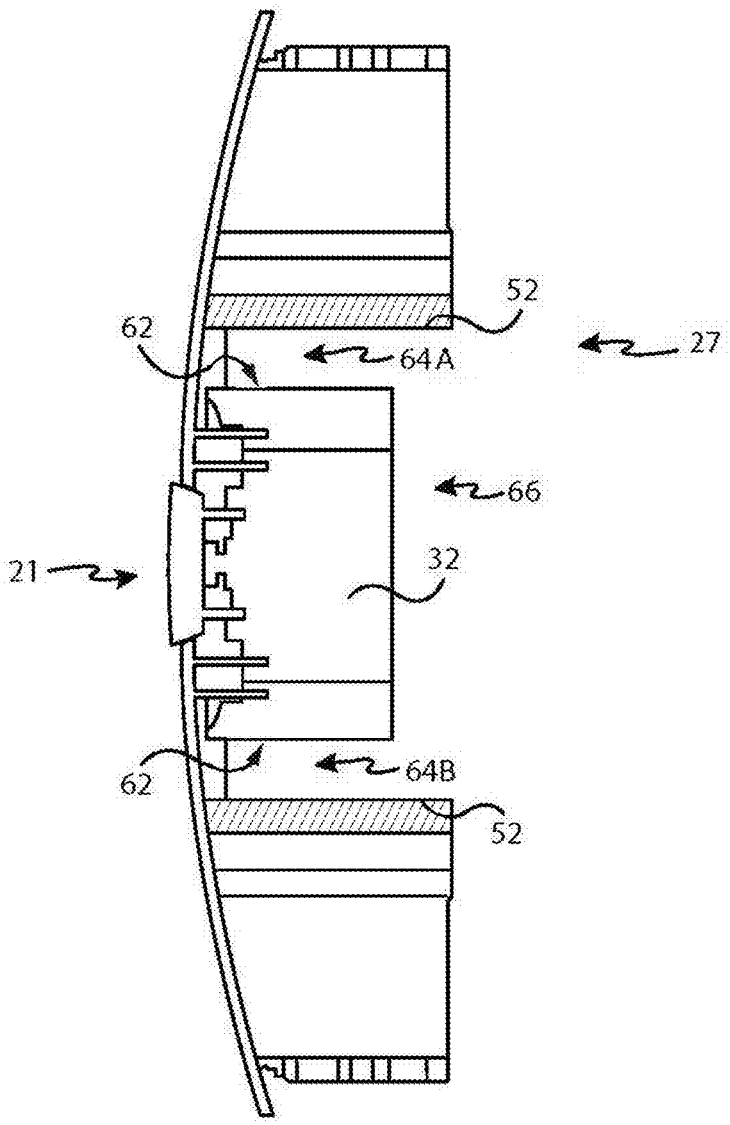
FIG. 8 is a cross-sectional view of the air tower taken along line 6-6 of FIG. 6.

In further illustration of the embodiment shown in FIG. 8 and FIG. 9*b*, there is a cross-sectional area 64A and 64B between the side surfaces 62 of the main body 32 and the interior side walls 52. Air in the first plenum chamber 44 flows through the cross-sectional area 64A and 64B into the second plenum chamber 45. Location 74 generally refers to the location of the cross-sectional area 64A and 64B that provides the narrowest passage way for air to flow through at any given position of the movable part 21. In the shown examples in FIG. 9*b*, FIG. 10*b* and FIG. 11*b*, there is space in between the side surfaces 62 of the main body 32 and the interior side walls 52. It is contemplated that one or both of the area 64A and 64B can be a complete seal at some position of the movable part 21. In the shown examples, the interior side walls 52 are formed in such a way that they curve in sharply at the connecting point of the first plenum chamber 44 and the damper 27, and gradually curve out inside the damper 27, and curve out sharply at the connecting point of the damper 27 and the second plenum chamber 45. As a result, the combined cross-sectional areas 64A and 64B are smallest when the movable part 21 is at the first position 72, and the combined cross-sectional areas 64A and 64B gradually increases as the movable part 21 is being slid downwards towards the second position 92, and the combined cross-sectional areas 64A and 64B reaches its maximum when the movable part reaches the second position 92. While the interior side walls 52 are shown to curve in this manner, it should be readily understood that the particular shape of the interior side walls 52 can vary in accordance with the invention. Of course, if so desired, the interior side walls 52 could also be constructed so as to be closest to the movable part at the second position yet further away from the movable part at the first position.

Therefore, as shown in FIG. 9*a* and FIG. 9*b*, when the movable part 21 is moved to the first position 72 (a.k.a. a Coldest Setting for the freezer), the combined cross-sectional area 64A and 64B is at a narrowest state, causing least amount of air being directed to the fresh food compartment. As a result, relatively more air is retained to the freezer and the freezer compartment is therefore set in a coldest state. As shown in FIG. 11*a* and FIG. 11*b*, when the movable part 21 is moved to a second position 92 (a.k.a. a Warm Setting for the freezer), the combined cross-sectional area 64A and 64B is at a widest state, and the amount of cooling air directed to the fresh food compartment 7 is at its maximum. As a result, relatively less air is directed to the freezer compartment 11 and the freezer compartment 11 is set in a warmest state. As shown in FIG. 10*a* and FIG. 10*b*, when the movable part 21 is moved to a third position 82 (a.k.a. a Mid Setting for the freezer), that locates somewhere between the first position 72 and the second position 92, the amount of cooling air flowing into the fresh food compartment 7 is more than that at the Coldest Setting, yet lesser than that at the Warm Setting. As a result, relatively lesser air is directed to the freezer compartment 11 compared to the Coldest Setting yet more compared to the Warm Setting, making the freezer compartment 11 a little warmer than the Coldest Setting but colder than the Warm Setting.

In such an embodiment, depending on a user's preference, the user can selectively slide the movable part 21 to an effectively infinite number of intermediate third positions 82 between the first position 72 and the second position 92, as shown in FIG. 10*a*, to allow a desired volume of cooling air to pass into the fresh food compartment. The greater the demand for keeping the freezer compartment 11 cold, the more towards the Coldest Setting should the user position the movable part 21, and consequently smaller volume of cooling air is passed into the fresh food compartment 7.

Although described with reference to some embodiments of the invention, it should be readily understood that various changes and/or modifications can be made to the invention without departing from the spirit thereof. For example, while only one air passageway was drawn, multiple air passageways can also be employed to direct air flow into various portions of the freezer compartment 11 in order to avoid temperature stratification.

What is claimed is:

1. An air tower adapted to be located within and attached to a wall of a first compartment of a refrigeration appliance, the air tower comprising:

a first plenum chamber in fluid communication with the first compartment of the refrigeration appliance;

a second plenum chamber in fluid communication with a second compartment of the refrigeration appliance;

a damper connecting the first plenum chamber to the second plenum chamber, wherein the damper is defined by a section of at least a first interior side wall and an opposed second interior side wall that is spaced apart and opposite the first interior side wall;

a movable part within the damper configured to be moveable between a first position and a second position;

a first surface facing an interior of the first compartment; and a second surface opposite the first surface and facing said wall of the first compartment;

wherein the movable part is located between the first and second interior side walls, and comprises a raised main body portion with at least a first movable part side wall and a second movable part side wall spaced apart and opposite the first movable part side wall;

wherein the first movable part side wall is adjacent to, spaced apart, and opposite the first interior side wall so as to define a first gap therebetween, and the second movable part side wall is adjacent to, spaced apart, and opposite the second interior side wall so as to define a second gap therebetween;

wherein when the movable part is moved to the first position, the movable part is relatively closer to at least one of the at least two spaced apart interior side walls and a width of at least one of the two gaps is reduced to thereby restrict air flow from the first plenum chamber to the second plenum chamber;

wherein when the movable part is moved to the second position, the movable part is relatively further away from the at least one of the at least two spaced apart interior side walls and said width of the at least one of the two gaps is increased to thereby permit more air flow from the first plenum chamber to the second plenum chamber;

wherein at an installed condition, the movable part is slidably attached to the second surface, and wherein the movable part comprises a graspable unit projecting away from the first surface through an opening in the first surface, so that at the installed condition a user may hold on to the graspable unit to slide the movable part between the first position and the second position.

2. The air tower of claim 1, wherein the first compartment is a freezer compartment maintaining air at a temperature less than or equal to zero degrees centigrade, and the second compartment is a fresh food compartment maintaining air at a temperature greater than zero degrees centigrade.

3. The air tower of claim 1, wherein the movable part is further configured to be moveable to a third position such that the movable part is further away from the interior side walls than the movable part is at the first position, but closer than the movable part is at the second position, thereby permitting relatively more airflow from the first plenum chamber to the second plenum chamber than when the movable part is at the first position, but less airflow than when the movable part is at the second position.

4. The air tower of claim 1, wherein the movable part is configured to be movable linearly between the first position and the second position.

5. The air tower of claim 1, wherein the first compartment comprises a freezer compartment.

6. The air tower of claim 1, wherein the air tower further comprises raised ribs disposed on the second surface in a predetermined arrangement to form at least two interior side walls within both the first plenum chamber and the second plenum chamber.

7. The air tower of claim 1, wherein the raised main body portion has at least one concave groove slidably fitting with at least one guide rail on the second surface of the air tower.

8. The air tower of claim 1, wherein the at least two interior side walls of the damper have a height greater or equal to the height of the raised main body portion.

9. The air tower of claim 1, wherein in the damper the at least two interior side walls form at least one passageway for air to flow over the movable part.

10. The air tower of claim 1, wherein the graspable unit comprises a knob.

11. The air tower of claim 10, wherein the movable part reaches the first position when the knob is slid to a first rim of the opening, and the damper reaches the second position when the knob is slid to a second rim of the opening facing the first rim.

12. The air tower of claim 2, wherein the air tower is attached to a rear wall of the freezer compartment.

13. The air tower of claim 3, wherein the third position is located at a position between the first position and the second position.

14. An air tower adapted to be located within and attached to a wall of a first compartment of a refrigeration appliance, the air tower comprising:

a first plenum chamber in fluid communication with the first compartment of the refrigeration appliance;

a second plenum chamber in fluid communication with a second compartment of the refrigeration appliance;

a damper connecting the first plenum chamber to the second plenum chamber, wherein the damper is defined by a section of at least two interior side walls;

a movable part within the damper configured to be moveable between a first position and a second position;

a first surface facing an interior of the first compartment; and a second surface opposite the first surface and facing said wall of the first compartment;

wherein the movable part comprises a raised main body portion;

wherein when the movable part is moved to the first position, the movable part is spaced a first distance from away from at least one of the at least two spaced apart interior side walls to thereby restrict air flow from the first plenum chamber to the second plenum chamber;

wherein when the movable part is moved to the second position, the movable part is spaced a second distance, which is greater than the first distance, away from the at least one of the at least two spaced apart interior side walls to thereby increase air flow from the first plenum chamber to the second plenum chamber;

wherein at an installed condition, the movable part is slidably attached to the second surface;

wherein the at least two interior side walls of the damper have a height greater than a height of the raised main body portion creating a minimum air flow from the first plenum chamber to the second plenum chamber in each position; and wherein the movable part comprises a graspable unit projecting away from the first surface through an opening in the first surface, so that at the installed condition a user may hold on to the graspable unit to slide the movable part between the first position and the second position.

* * * * *